US005361696A

United States Patent [19]

Kato et al.

[11] Patent Number: 5,361,696

[45] Date of Patent: Nov. 8, 1994

[54] PRESET STATE DISPLAY APPARATUS AND PRESET STATE ADJUSTING APPARATUS

[75] Inventors: Kazuhiko Kato; Katsuo Shibasaki, both of Ibaragi, Japan

[73] Assignee: Komori Corporation, Tokyo, Japan

[21] Appl. No.: 99,101

[22] Filed: Jul. 29, 1993

[30] Foreign Application Priority Data

Aug. 10, 1992 [JP] Japan ..... 4-061381

[51] Int. Cl.[5] ..... B41F 13/24

[52] U.S. Cl. ..... 101/232; 101/494; 364/471

[58] Field of Search ..... 101/232, 219, 212, 216, 101/494; 395/155; 364/471

[56] References Cited

U.S. PATENT DOCUMENTS 4,495,599 1/1985 Haag et al. ..... 364/900
4,553,830 11/1985 Nguyen ..... 355/209
4,644,499 2/1987 Shibazaki et al. ..... 355/55

FOREIGN PATENT DOCUMENTS 0158797 10/1985 European Pat. Off. .
0160167 11/1985 European Pat. Off. .
0243697 11/1987 European Pat. Off. .
2427912 1/1980 France .
61-291138 12/1986 Japan .
2078959 1/1982 United Kingdom .
2156786 10/1985 United Kingdom .
2161751 1/1986 United Kingdom .

OTHER PUBLICATIONS

Patent Abstracts of Japan, vol. 11, No. 158 (M-591) May 22, 1987 & JP-A-61 291 139 (Dianippon Printing Co. Ltd).

*Primary Examiner*—Eugene H. Eickholt
*Attorney, Agent, or Firm*—Blakely, Sokoloff, Taylor & Zafman

[57] ABSTRACT

A preset state display apparatus includes a position detector, a memory, and a display. The position detector detects a set state of an adjustment portion adjusted in a change in printed matter or the like in a printing press. The memory stores a current set state of the adjustment portion which is detected by the position detector in correspondence with a key number represented by a storage command generated upon designation of the key number. The display calls, as a preset state, the set state of the adjustment portion which is stored in correspondence with the designated key number, in accordance with a call command generated upon designation of the key number, to display the preset state near an operation member corresponding to the adjustment portion.

4 Claims, 8 Drawing Sheets

PRESET STATE DISPLAY APPARATUS AND PRESET STATE ADJUSTING APPARATUS

BACKGROUND OF THE INVENTION

The present invention relates to a preset position (preset state) display apparatus for displaying the preset position of an adjustment portion adjusted in a change in printed matter or the like in a printing press, and a preset position adjusting apparatus for automatically setting the preset position of the adjustment portion.

In a conventional printing press, the set state of each adjustment portion is set in an appropriate state for printed matters (preset state) in a change in printed matter or the like.

For example, in the delivery unit of a sheet-fed rotary press, the set state of each adjustment portion such as the position of a sheet release cam or a sucker wheel, the rotational speed of a fan, and an air volume are set to the preset states by operating a dial or lever corresponding to the adjustment portion.

The delivery unit has an important function of properly delivering and stacking printing paper, and this function is evaluated as paper alignment performance. The paper alignment performance is determined by the set state of each adjustment portion such as the position of the sheet release cam or the sucker wheel, the rotational speed of the fan, and the air volume. The set state is adjusted every time the printed matter is changed, thereby obtaining desired paper alignment performance.

Conventionally, however, the preset state for each adjustment portion is determined by experiences and skills of an operator every time the printed matter is changed. For this reason, variations are caused by the degrees of skills of the operators. The same preset state for the same printed matter as in the last operation is hardly reproduced, and quality such as printing condition or paper alignment in the delivery unit is unstable. Adjustment requires a lot of time, which varies with the degrees of skills of the operators. Therefore, a skilled operator is inevitably required.

A technique is disclosed in Japanese Patent Laid-Open No. 61-291138 titled "METHOD AND APPARATUS FOR SETTING OF INK POT IN EARLY PERIOD FOR OFFSET PRINTING". According to this technique, when the same opening degree of an ink pot for the same printed matter as in the last operation is to be set, the last setting recorded in a magnetic card is displayed. The opening degree of the ink pot is manually set to the displayed preset state.

In this case, however, using a magnetic card as a data storage medium causes following problems.

(1) Since a stand-alone magnetic card is used, the data may be lost due to mechanical or magnetic damage of the card.

(2) The magnetic card requires a preparing operation, and it takes much time. Safekeeping/management of the card is also needed.

(3) A reader and a writer for the magnetic card are required, which causes an increase in cost.

SUMMARY OF THE INVENTION

It is an object of the present invention to eliminate variations caused by the degrees of skills of the operators, reproduce the same preset state as in the last operation, shorten the adjustment time, and simplify and standardize the adjustment, thereby reducing necessity of skilled operators.

It is another object of the present invention to provide better protection for the data as compared to the use of a magnetic card, save time for preparation, safekeeping, and management of the magnetic card, and eliminate the reader and the writer to totally reduce the cost.

In order to achieve the above objects, there is provided a preset state display apparatus comprising set state detecting means for detecting a set state of an adjustment portion adjusted in a change in printed matter or the like in a printing press, set state storage means for storing a current set state of the adjustment portion which is detected by the set state detecting means in correspondence with a key number represented by a storage command generated upon designation of the key number, and preset state display means for calling, as a preset state, the set state of the adjustment portion which is stored in correspondence with the designated key number, in accordance with a call command generated upon designation of the key number.

According to the present invention, when a storage command is issued upon designation of a key number, the current set state of the adjustment portion is stored in correspondence with the key number. When a call command is issued upon designation of the key number, the set state of the adjustment portion which is stored in correspondence with the key number is called as a preset state and displayed near an operation member for the adjustment portion. In accordance with the display, the same preset state as in the last operation can manually be reproduced.

In the present invention, when a storage command is issued upon designation of a key number, the current set state of the adjustment portion is stored in correspondence with the key number. When a call command is issued upon designation of the key number, the set state of the adjustment portion which is stored in correspondence with the key number is called as a preset state, and the set state of the adjustment portion is automatically set to the preset state. Thus, the same preset state as in the last operation can automatically be reproduced.

DESCRIPTION OF THE PREFERRED EMBODIMENTS

The present invention will be described in detail on the basis of preferred embodiments.

FIRST EMBODIMENT

Figure 1A:
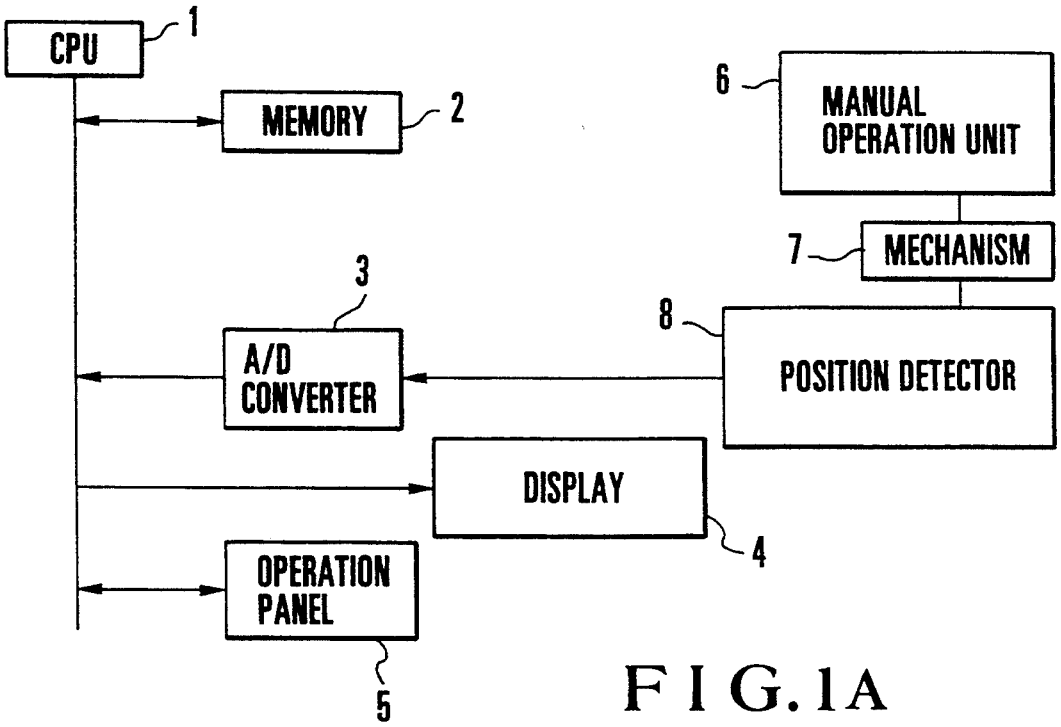
FIGS. 1A and 1B are block diagrams showing an embodiment of a preset state display apparatus and a preset state adjusting apparatus according to the present invention.

FIG. 1A shows a preset state display apparatus according to the first embodiment of the present invention. Referring to FIG. 1A, reference numeral 1 denotes a CPU; 2, a memory; 3, an A/D converter; 4, a display; 5, an operation panel; 6, a manual operation unit; 7, a mechanism; and 8, a position detector. The mechanism 7 determines the set state (set state) of a predetermined adjustment portion in response to the operating state of the manual operation unit (operation member).6. The position detector 8 detects the current set state of the adjustment portion on the basis of the state of the mechanism 7. The operation member 6, the mechanism 7, and the position detector 8 are provided corresponding to each adjustment portion.

Figure 2:
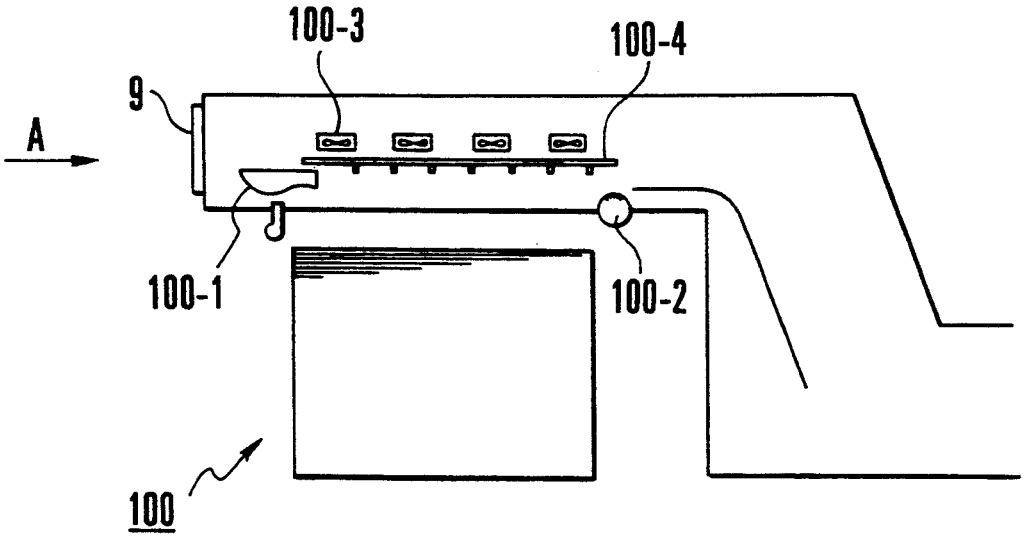
FIG. 2 is a side view showing the main part of a delivery unit in a sheet-fed rotary press.

FIG. 2 shows a delivery unit in a sheet-fed rotary press. In this embodiment, the positions of a sheet release cam 100-1 and a sucker wheel 100-2, the rotational speed of a fan 100-3, and an air volume from an air spray 100-4 in the delivery unit 100 are specified as adjustment portions. The operation member 6, the mechanism 7, and the position detector 8 are provided to each adjustment portion. The positions of the sheet release cam 100-1 and the sucker wheel 100-2 are detected by a potentiometer, the rotational speed of the fan 100-3 is detected by a voltage applied to a DC motor of the fan, and the air volume from the air spray 100-4 is detected by a potentiometer provided to a motor which controls the opening degree of a flow control valve.

Figure 3:
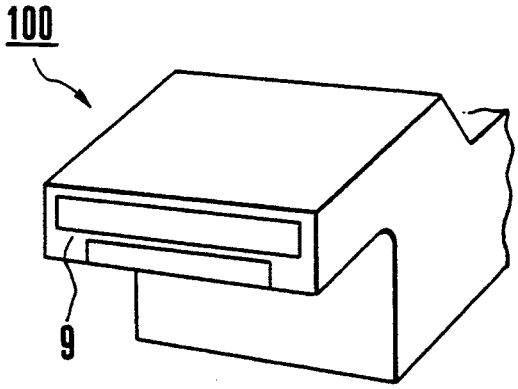
FIG. 3 is a perspective view of the delivery unit shown in FIG. 2 when viewed from a direction indicated by an arrow A.
Figure 4:
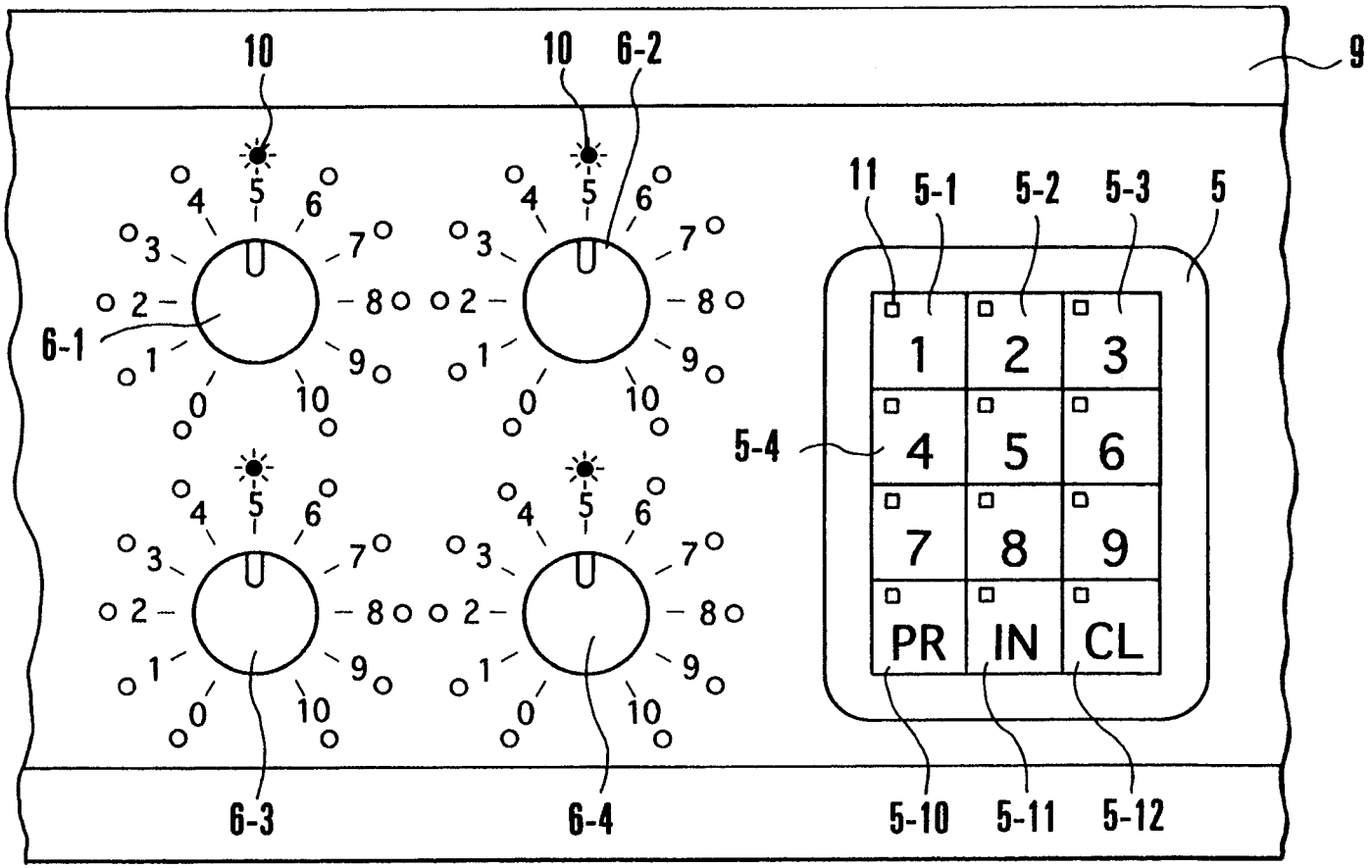
FIG. 4 is a cutaway front view showing the main part of an adjustment operation panel provided to the delivery unit.

As shown in FIG. 3, an adjustment operation panel 9 is provided to the delivery unit 100. FIG. 4 shows the main part of the adjustment operation panel 9. Operation members 6-1 to 6-4 correspond to the sheet release cam 100-1, the sucker wheel 100-2, the fan 100-3, and the air spray 100-4, respectively. In this embodiment, dials are used as the operation members 6-1 to 6-4, and the set state of the corresponding adjustment portion can be adjusted stepwise in accordance with the angular position of a dial. Light-emitting diodes (LEDs) 10 are arranged around the operation members 6-1 to 6-4 on the panel surface for all adjustment levels, and the LEDs 10 constitute the display 4. The operation panel 5 comprising keys 5-1 to 5-12 is provided to the adjustment operation panel 9. LEDs 11 are provided to the keys 5-1 to 5-12, respectively.

The operation of the preset state display apparatus will be described below. [Registration of Set State of Each Adjustment Portion]

Assume that the set states of each adjustment portion for the first, second, and third printed matters are registered in correspondence with the "#1" key 5-1, the "#2" key 5-2, and the "#" key 5-3, i.e., the key numbers "#1", "#2", and "#3". In this case, as shown in FIG. 5A, the LEDs 11 at the "#" key 5-1, the "#2" key 5-2, and the "#3" key 5-3 are ON.

In this situation, assume that the set state of each adjustment portion for the fourth printed matter is to be registered in correspondence with the key number "#4". In this case, a skilled operator is assigned for the fourth printed matter. The operator manually adjusts the angular positions of the operation members 6-1 to 6-4 while observing the delivery condition in the delivery unit 100 so as to obtain desired paper alignment performance.

Figure 5A:
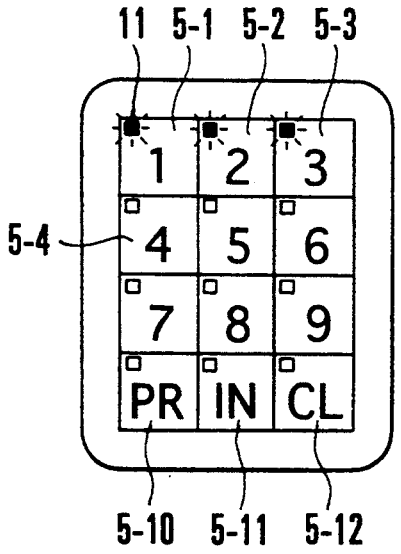
FIGS. 5A to 5D are views for explaining registration of the set state of each adjustment portion at an operation panel provided to the adjustment operation panel.
Figure 5B:
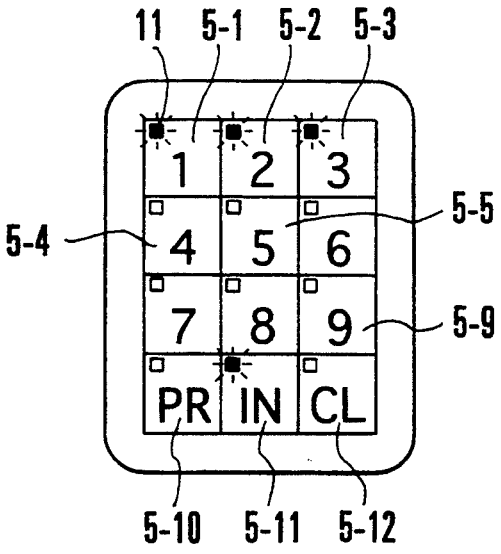

The data storage mode set key ("IN" key) 5-11 is depressed in FIG. 5A. When the "IN" key 5-11 is depressed, the LED 11 at the "IN" key 5-11 is turned on, as shown in FIG. 5B.

Figure 5C:
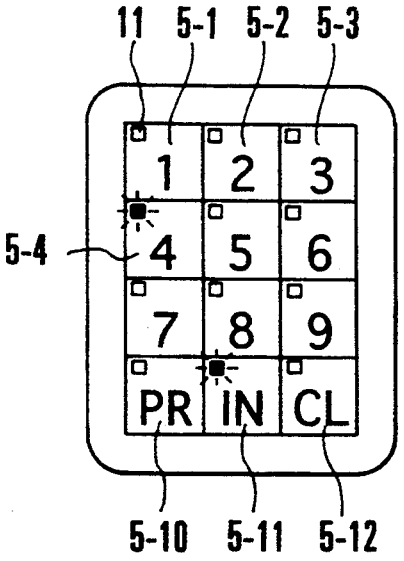
Figure 5D:
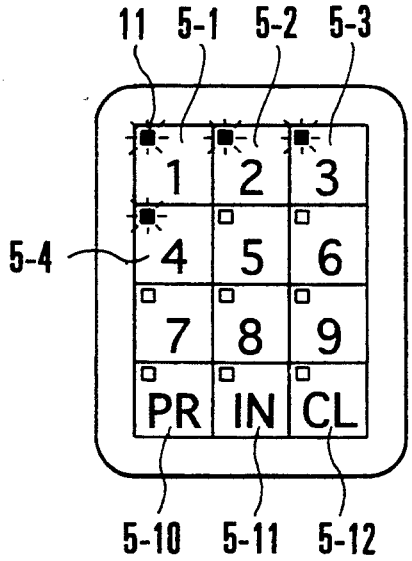

The "#4" key 5-4 is then depressed. The ON/OFF states of the LEDs 11 at other "#" keys ("#1" key 5-1 to "#3" key 5-3 and "#5 " key 5-5 to "#9" key 5-9) are stored in the memory 2. At the same time, the LEDs at the "#1" key 5-1 to the "#3" key 5-3 are turned off while the LED 11 at the "#4" key 5-4 is turned on (FIG. 5C). Thus, the operator can visually confirm, in distinction from other key numbers, that the key number "#4" is selected. When the "IN" key 5-11 is depressed, the LED 11 at the "IN" key 5-11 is turned off. At the same time, the ON/OFF states of the LEDs 11 at the "#1" key 5-1 to the "#3" key 5-3, and the "#5" key 5-5 to the "#9" key 5-9 are read out, and the ON/-OFF states of the LEDs 11 are restored to the readout states (FIG. 5D).

By this series of operations, a storage command upon designation of "#4" key 5-4, i.e., the key number "#4", is issued. In correspondence with the key number "#4", the current set state of each adjustment portion which is detected by each position detector 8, i.e., the adjustment levels of the operation members 6-1 to 6-4, is digitized by the A/D converter 3 and stored (registered) in the memory 2. The state in which the set state of each adjustment portion is registered in the memory 2 in correspondence with the key number "#4" can visually be confirmed by the ON state of the LED 11 at the "#4" key 5-4.

Since, instead of a magnetic card, the memory 2 is used to store the set state of each adjustment portion in correspondence with the designated key number, the data is hardly be lost. The time for preparation, safekeeping, and management of the card can be saved, and neither a reader nor a writer are required, thereby totally reducing the cost. [Adjustment of Each Adjustment Portion to Registered Set State]

Figure 6A:
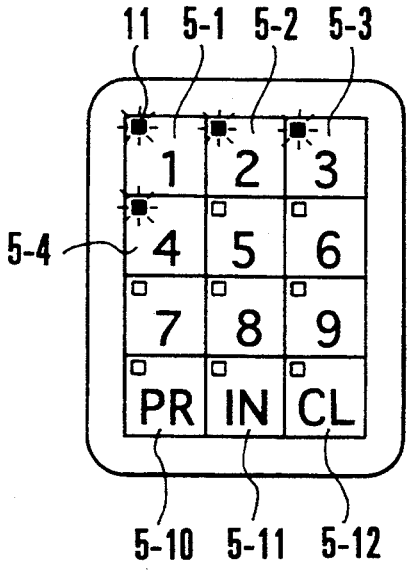
FIGS. 6A to 6D are views for explaining adjustment of each adjustment portion to the registered set state at the operation panel provided to the adjustment operation panel.
Figure 6B:
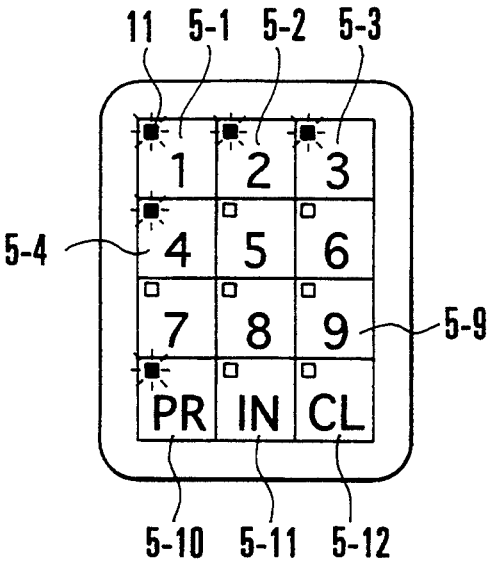

Assume that the display on the operation panel 5 is in a state shown in FIG. 6A, and the printed matter is to be replaced with the fourth printed matter. In this case, the preset key ("PR" key) 5-10 is depressed to switch the normal "operation" mode to the "preset" mode. When the preset key 5-10 is depressed, the LED 11 at the preset key 5-10 is turned on (FIG. 6B) while the LEDs 10 around the operation members 6-1 to 6-4 are turned off.

Figure 6C:
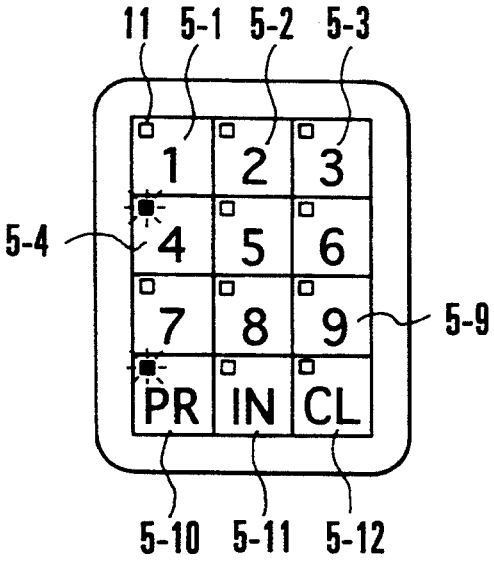

The "#4" key is then depressed. The ON/OFF states of the LEDs 11 at the "#" keys ("#1" key 5-1 to "#9" key 5-9) are stored in the memory 2 while all of the LEDs 11 at the "#" keys except for the "#4" key are turned off (FIG. 6C). At the same time, a call command upon designation of the "#4" key, i.e., the key number "#4", is issued. The set state of each adjustment portion which is stored in the memory 2 in correspondence with the key number "#4", i.e., the adjustment levels at the operation members 6-1 to 6-4, is called as a preset state. The LEDs 10 around the operation members 6-1 to 6-4 are turned on in accordance with the adjustment levels.

The operator sets the operation members 6-1 to 6-4 to the displayed adjustment levels (preset states) with reference to the ON states of the LEDs 10. Thus, the same preset state for the same printed matter as in the last operation can be reproduced, a skilled operator is not required, and the adjustment time can be shortened, and the adjustment can be simplified and standardized. Since a skilled operator determines the preset state for each printed matter, variations caused by the degrees of skills of the operators can be avoided, and stable paper alignment performance can be obtained.

Figure 6D:
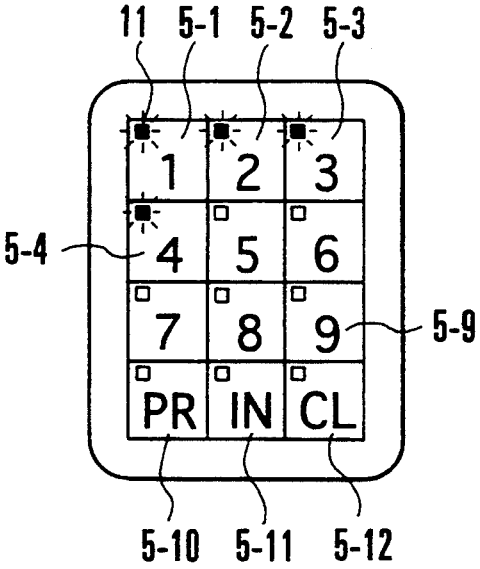

After the adjustment levels of the operation members 6-1 to 6-4 are set to the preset states, the "PR" key 5-10 is depressed. When the "PR" key 5-10 is depressed, the LED 11 at the "PR" key 5-10 is turned off. The ON/-OFF states at the "#1" key 5-1 to the "#9" key 5-9, which are stored in the memory 2, are read out, and the ON/OFF states of the LEDs 11 are restored to the readout states (FIG. 6D). The "preset" mode is switched to the normal "operation" mode. In the normal "operation" mode, the LEDs 10 are turned on in correspondence with the adjustment levels of the operation members 6-1 to 6-4.

Erase of Registered Set State of Each Adjustment Portion

Figure 7A:
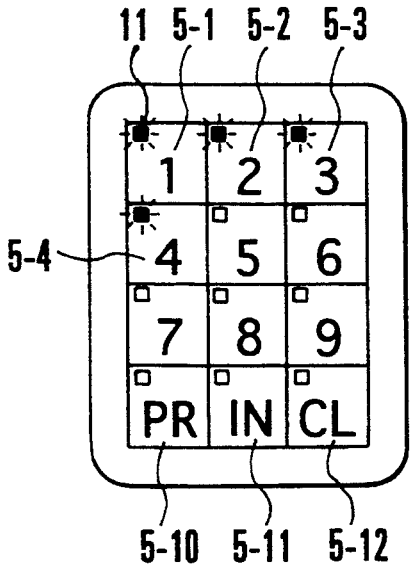
FIGS. 7A and 7B-D are views for explaining erasure of the registered set state of each adjustment portion at the operation panel provided to the adjustment operation panel.
Figure 7B:
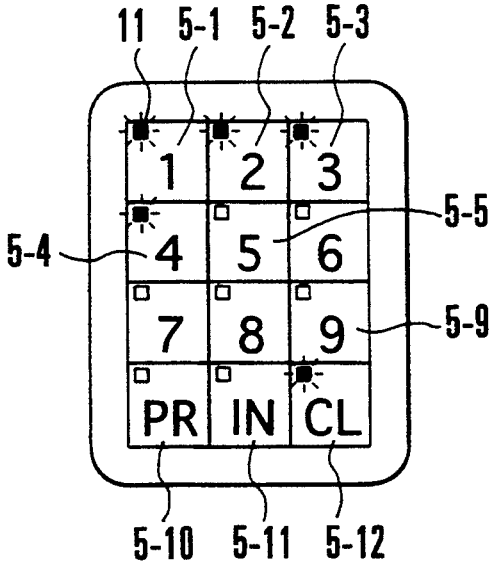

The set state of each adjustment portion stored in the memory 2 in correspondence with the key number can desirably be erased. Assume that the set state of each adjustment portion, which is registered in correspondence with the key number "#4", is to be erased. In this case, the data erase mode set key ("CL" key) 5-12 is depressed in FIG. 7A. When the "CL" key 5-12 is depressed, the LED 11 at the "CL" key 5-12 is turned on, as shown in FIG. 7B.

Figure 7C:
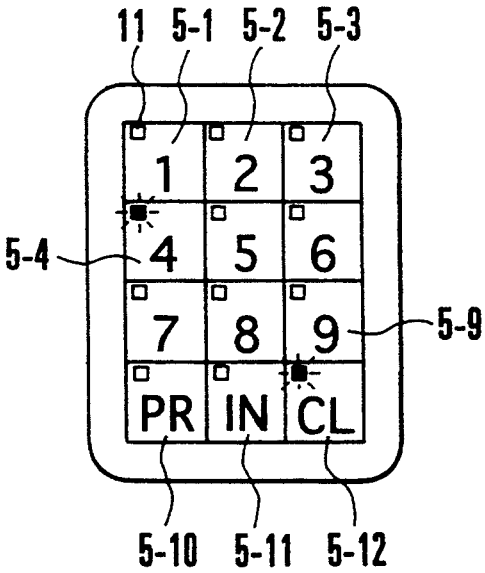
Figure 7D:
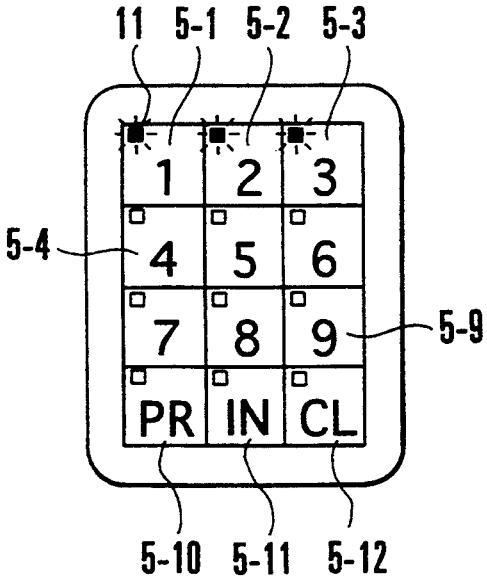

The "#4" key 5-4 is then depressed. The ON/OFF states of the LEDs 11 at other "#" keys ("#1" key 5-1 to "#3" key 5-3 and "#5" key 5-5 to "#9" key 5-9) are stored in the memory 2. At the same time, the LEDs 11 at the "#1" key 5-1 to the "#3" key 5-3 are turned off (FIG. 7C). The operator can visually confirm, in distinction from other key numbers, that the key number "#4" is selected. When the "CL" key 5-12 is depressed, the LED 11 at the "CL" key 5-12 is turned off. The ON/OFF states of the LEDs 11 at the "#1" key 5-1 to the "#3" key 5-3 and the "#5" key 5-5 to the "#9" key 5-9, which are stored in the memory 2, are read out, and the ON/OFF states of the LEDs 11 are restored to the readout states. At the same time, the LED 11 of the "#4" key 5-4 is turned off (FIG. 7D).

By this series of operations, a storage erase command upon designation of the key number "#4" is issued, and the set state of each adjustment portion, which is stored in the memory 2 in correspondence with the key number "#4" is erased.

Figure 8A:
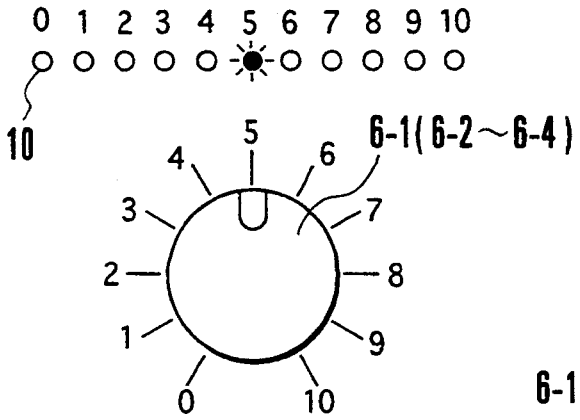
FIGS. 8A and 8B are views showing another example of display of the preset state (adjustment level) for an operation member (dial) provided to the adjustment operation panel.
Figure 8B:
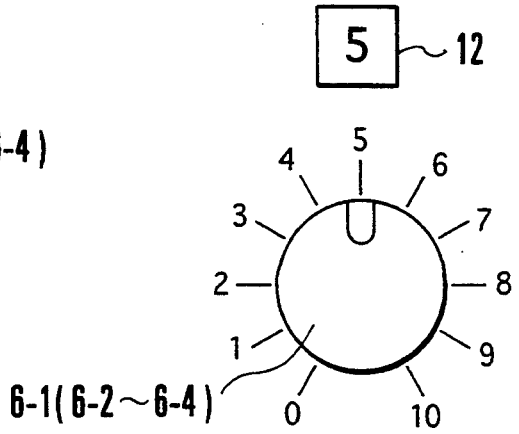

In the above arrangement, the LEDs 10 are arranged around the operation members 6-1 to 6-4 for each adjustment level. Instead, as shown in FIG. 8A, the adjustment levels may be displayed on the upper panel surface of each of the operation members 6-1 to 6-4, and the LEDs 10 may be arranged for each adjustment level. In addition, as shown in FIG. 8B, a digital display 12 may be provided on the upper panel surface of each of the operation members 6-1 to 6-4, and the adjustment levels may be displayed on the digital display 12.

Figure 9A:
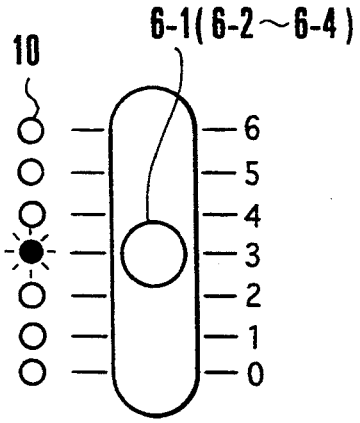
FIGS. 9A and 9B are views showing an example of display of the preset state (adjustment level) for a lever used as the operation member.
Figure 9B:
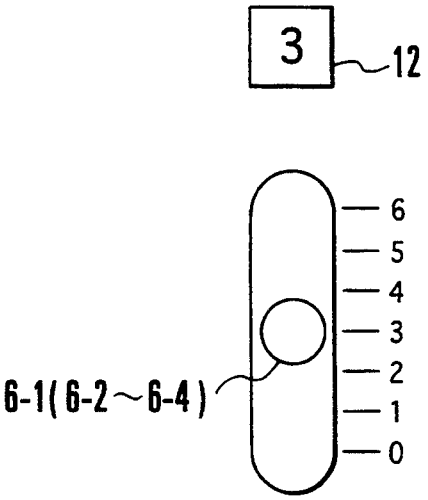
Figure 10:
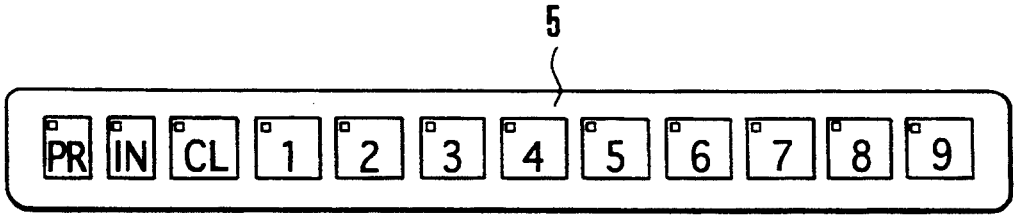
FIG. 10 is a view showing keys of the operation panel, which are horizontally arranged.

Although dials are used as the operation members 6-1 to 6-4 in the above embodiment, levers may also be used. FIGS. 9A and 9B show an example of display when levers are used as the operation members 6-1 to 6-4.

Although the keys 5-1 to 5-12 are arranged in a matrix on the operation panel 5, the keys may be horizontally arranged. In addition, when a detector which can detect the state of the mechanism 7 as a digital signal is used as the position detector 8, the A/D converter 3 can be omitted.

Second Embodiment

Figure 1B:
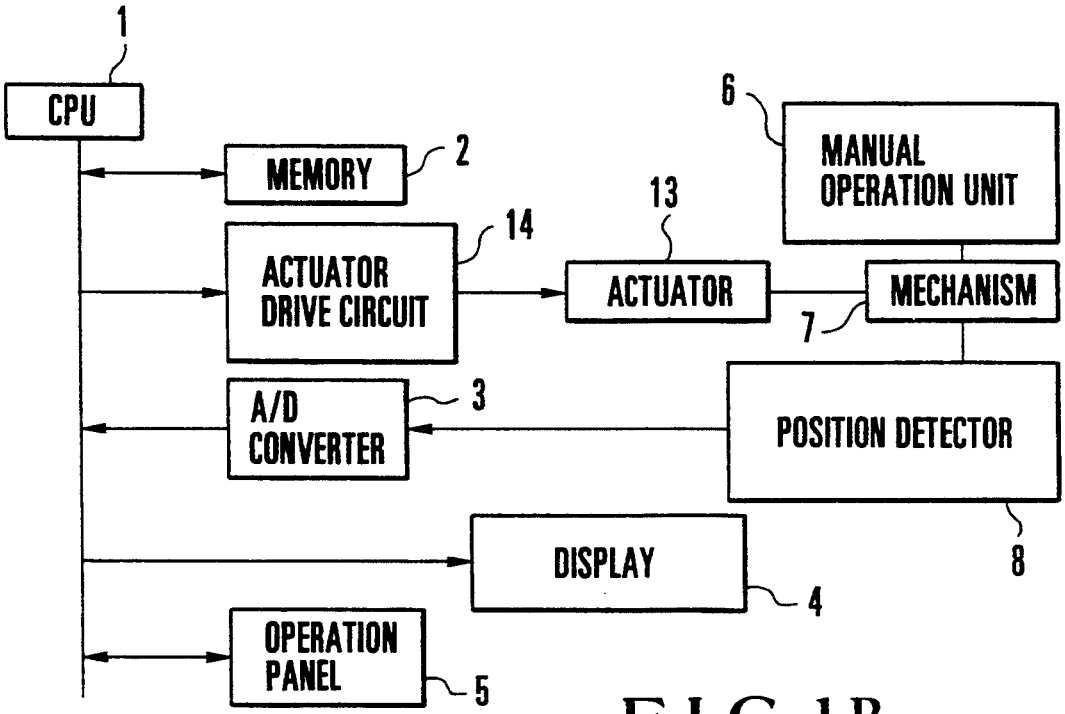

FIG. 1B shows a preset state adjusting apparatus according to the second embodiment of the present invention. Referring to FIG. 1B, the same reference numerals as in FIG. 1A denote the same or equal parts in FIG. 1B, and a detailed description thereof will be omitted. In this embodiment, an actuator 13 and an actuator drive circuit 14 are provided to each mechanism 7.

In this embodiment, a "PR" key 5-10 is depressed to set the "preset" mode in a change in printed matter. A "#4" key 5-4 is then depressed, and a call command upon designation of the key number "#4" is issued. The set state of each adjustment portion, which is stored in a memory 2 in correspondence with the key number "#4", i.e., the adjustment levels of the operation members 6-1 to 6-4, is called. The actuator 13 is driven through the actuator drive circuit 14 such that the called adjustment level (preset state) is set, thereby automatically adjusting the state of each mechanism 7. Thus, the same preset state for the same printed matter as in the last operation can automatically be reproduced, thereby improving the efficiency and reducing the operator load.

Although the preset states are displayed on a display 4 around the operation members 6-1 to 6-4, the display 4 may be omitted.

Although the first and second embodiments show an application to the delivery unit 100, the present invention can also be applied to other units such as a sheet feeding unit. The present invention is applicable to all adjustment portions in a printing press.

Figure 11:
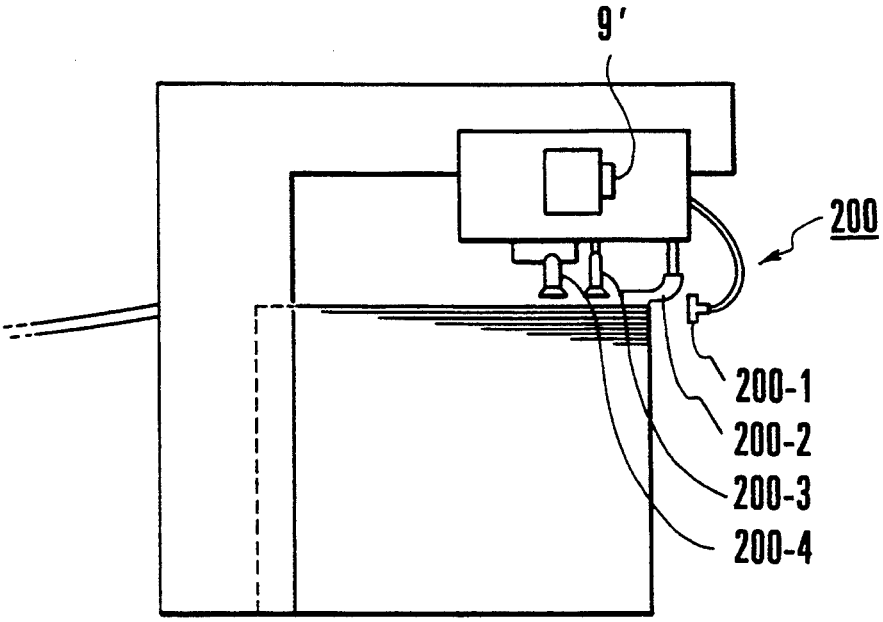
FIG. 11 is a side view showing the main part of a sheet feeding unit as an application to another unit.
Figure 12:
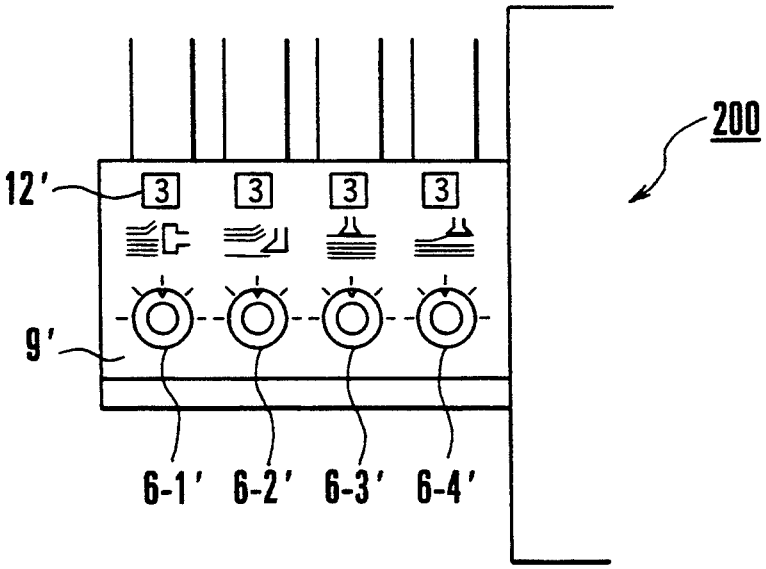
FIG. 12 is a front view of an adjustment operation panel provided to the sheet feeding unit.

An application to a sheet feeding unit is shown in FIGS. 11 and 12. In this case, the air volumes of a sheet separator 200-1, a spray nozzle 200-2, a first sucker 200-3, and a second sucker 200-4 are specified as adjustment portions in the sheet feeding unit 200. Operation members 6-1' to 6-4' are provided to an adjustment operation panel 9', and a digital display 12' is provided to the upper panel surface of each of the operation members 6-1' to 6-4'.

Although the present invention is applied to a single printing press in the first and second embodiments, the apparatus may separately be provided and applied to a plurality of printing presses.

As has been apparent from the above description, according to the present invention, when a storage command is generated upon designation of a key number, a current set state of an adjustment portion is stored in correspondence with the key number. When a call command is generated upon designation of the key number, the set state of the adjustment portion, which is stored in correspondence with the key number, is called as a preset state. The preset state is displayed near an operation member corresponding to the adjustment portion, or the set state of the adjustment portion is automatically set to the preset state. Thus, the same preset state as in the last operation can manually or automatically be reproduced. Therefore, variations caused by the degrees of skills of the operators can be avoided, the adjustment time can be shortened, the adjustment can be simplified and standardized, and the necessity of skilled operators is reduced.

In addition, better protection for the data can be obtained as compared to the use of a magnetic card, no time is required for preparation, safekeeping, and management of the magnetic card, and a reader and a writer can be omitted, thereby totally reducing the cost.

What is claimed is:

1. A preset state display apparatus comprising:

set state detecting means for detecting a set state of an adjustment portion adjusted in a change in printed matter in a printing press;

set state storage means for storing a current set state of said adjustment portion which is detected by said set state detecting means in correspondence with a plurality of key number switches corresponding to each key number represented by a storage command generated upon designation of said plurality of key number switches corresponding to each key number; and preset display means for calling, storing, and erasing, as a preset state, the set state of said adjustment portion which is stored in correspondence with the designated key number, in accordance with a call command generated upon designation of said plurality of key number switches corresponding to each key number, to display the preset state near an operation member corresponding to said adjustment portion.

2. An apparatus according to claim 1, further comprising light-emitting diodes arranged around said operation member for representing a set state of said adjustment portions.

3. An apparatus according to claim 1, further comprising light-emitting diodes linearly arranged for representing a set state of said adjustment portions, near said operation member.

4. An apparatus according to claim 1, further comprising a digital display, arranged on an upper panel surface of said operation member, for displaying a set state of said adjustment portions.

* * * * *